US012130010B2

(12) United States Patent
Kim et al.

(10) Patent No.: US 12,130,010 B2
(45) Date of Patent: Oct. 29, 2024

(54) CONNECTION TUBE SUPPORT OF WASTE HEAT RECOVERY BOILER AND WASTE HEAT RECOVERY BOILER INCLUDING SAME

(71) Applicant: DOOSAN ENERBILITY CO., LTD., Changwon (KR)

(72) Inventors: Uk Kim, Changwon (KR); Jae Cheol Kim, Busan (KR); Min Su Kim, Gimhae (KR); Jung Ah Son, Changwon (KR); Young Wook Lee, Changwon (KR); Jong Ho Hong, Changwon (KR); Kyu Man Kim, Busan (KR)

(73) Assignee: DOOSANENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/365,515

(22) Filed: Aug. 4, 2023

(65) Prior Publication Data

US 2024/0175572 A1 May 30, 2024

(30) Foreign Application Priority Data

Nov. 29, 2022 (KR) ..... 10-2022-0162829

(51) Int. Cl.

| | |
|---|---|
| ***F28F 9/013*** | (2006.01) |
| ***F22B 1/18*** | (2006.01) |
| ***F28D 1/053*** | (2006.01) |

(52) U.S. Cl.

CPC ..... *F22B 1/1884* (2013.01); *F28D 1/05308* (2013.01); *F28F 9/0135* (2013.01); *F28F 9/0138* (2013.01)

(58) Field of Classification Search

CPC ..... F28F 9/013; F28F 9/0131; F22B 31/003; F22B 37/208; F22B 21/22; F22B 37/108; C10G 9/20; F16L 3/23

See application file for complete search history.

(56) References Cited

U.S. PATENT DOCUMENTS 3,215,123 A * 11/1965 Olsen ..... F22B 37/108 110/302
3,805,745 A 4/1974 Block et al.
(Continued)

FOREIGN PATENT DOCUMENTS

CN 1802535 A * 7/2006 ..... F22B 1/1815
CN 206310471 U * 7/2017
(Continued)

*Primary Examiner* — Gregory A Wilson
(74) *Attorney, Agent, or Firm* — Harvest IP Law, LLP

(57) ABSTRACT

Proposed is a connection tube support of a waste heat recovery boiler supporting a connection tube unit having a plurality of connection tubes that is disposed inside a waste heat recovery boiler and perform heat exchange between a fluid flowing inside and exhaust gas flowing outside, wherein the connection tube support includes a header storing fluid flowing through the connection tube unit and supporting one end of the connection tube unit by being connected to one end of the connection tube unit, and a tube sheet supporting a circumferential surface of each of the plurality of connection tubes, wherein the tube sheet has the plurality of connection tubes having been passed therethrough and is provided with a plurality of support holes respectively supporting circumferential surfaces of the plurality of connection tubes having been passed therethrough.

16 Claims, 8 Drawing Sheets

(56) References Cited

U.S. PATENT DOCUMENTS

| | | | | | |
|---|---|---|---|---|---|
| 3,916,990 | A * | 11/1975 | Ruhe | F28D 7/1669 165/158 |
| 5,036,903 | A * | 8/1991 | Shook | F28F 19/02 165/905 |
| 5,653,282 | A * | 8/1997 | Hackemesser | F28F 9/22 165/DIG. 402 |
| 9,897,308 | B2 * | 2/2018 | Lobscheid | F22B 37/74 |
| 10,921,065 | B2 * | 2/2021 | Mahajan | F28F 9/013 |
| 2007/0141424 | A1 * | 6/2007 | Armstrong | H01M 8/0252 429/495 |
| 2013/0180471 | A1 | 7/2013 | Truong | |
| 2013/0264037 | A1 | 10/2013 | Otsubo | |
| 2021/0131314 | A1 | 5/2021 | Bairley | |

FOREIGN PATENT DOCUMENTS

| | | | | | |
|---|---|---|---|---|---|
| CN | 115183213 | A | * | 10/2022 | |
| JP | 2001-012878 | A | | 1/2001 | |
| JP | 2018-80852 | A | | 5/2018 | |
| JP | 2018080852 | A | * | 5/2018 | |
| KR | 10-2000-0074798 | A | | 12/2000 | |
| KR | 10-1465047 | B1 | | 12/2014 | |
| KR | 1465047 | B1 | * | 12/2014 | |
| KR | 10-2016-0104496 | A | | 9/2016 | |
| KR | 2016104496 | A | * | 9/2016 | F22B 37/36 |
| KR | 101720044 | B1 | * | 3/2017 | |
| WO | WO-03067170 | A1 | * | 8/2003 | B01J 19/006 |

* cited by examiner

Prior Art

CONNECTION TUBE SUPPORT OF WASTE HEAT RECOVERY BOILER AND WASTE HEAT RECOVERY BOILER INCLUDING SAME

CROSS REFERENCE TO RELATED APPLICATION

The present application claims priority to Korean Patent Application No. 10-2022-0162829, filed on Nov. 29, 2022, the entire contents of which are incorporated herein for all purposes by this reference.

BACKGROUND OF THE INVENTION

1. Field of the Invention

The present disclosure relates to a connection tube support of a waste heat recovery boiler and a waste heat recovery boiler including the same. More particularly, the present disclosure relates to a connection tube support of a waste heat recovery boiler and a waste heat recovery boiler including the same, wherein the connection tube support supports a connection tube unit, which is disposed inside the waste heat recovery boiler and exchanges heat between a fluid flowing inside and exhaust gas flowing outside.

2. Description of the Background Art

In general, a waste heat recovery boiler constitutes, together with a gas turbine system and a steam turbine system, a combined power generation system. The waste heat recovery boiler is often used as a subsidiary system to recover the heat of the combustion gas exhausted after driving the gas turbine and drive the steam turbine again.

Such a waste heat recovery boiler is called a heat exchanger together with a nuclear steam generator, a feed water heater, a condenser, an evaporator, and the like and, as shown in FIG. 1, has therein a support frame 70, a fin tube 10, a fin tube support 30, a header 60, and the like. Here, the fin tube 10 is designed to facilitate heat exchange by allowing fluids with different materials and temperatures to flow inside and outside of it, respectively. To create a block, hundreds to thousands of these fin tubes are assembled.

Due to the presence of high-flow energy, the combustion gas passing through the inside of the fin tube 10 requires rigid attachment to the header 60. This prevents any potential damage caused by vibration waves generated by the internal flow of the combustion gas. The header 60 serves to collect the combustion gas flowing in through the fin tube 10.

Here, given the considerable length of the fin tube 10, the fin tube support 30 is installed on the inner wall surface of a boiler body to securely fix the fin tube 10 at an intermediate position along its length. The fin tube support 30 has a plurality of insertion holes 40 that allow the fin tube 10 to pass through and be securely fixed in place.

When the fin tube 10 vibrates due to the internal flow of the combustion gas or thermal deformation occurs in the fin tube 10 due to high temperature and high pressure of the combustion gas during the operation of the waste heat recovery boiler, a phenomenon can occur where the fin 20 becomes restricted and caught on the fin tube support 30 as shown in FIG. 2. This can lead to local buckling as shown in FIG. 3. Since the fin tube 10 is inserted tightly into the hole 40 and supported to prevent movement, these constraints contribute to the occurrence of such phenomena.

Therefore, several issues may arise, including breakage in the fin tube support 30, cracks in the welded portion between the fin tube 10 and the header 60, and thermal separation within the fin tube 10 itself.

Meanwhile, in the related art, when the vibration and thermal deformation occur in the fin tube 10, the above problems have been solved by drilling the insertion hole 40 to be a little larger than the diameter of the fin tube 10, so that the fin tube 10 may move in an axial direction through the inner space of the insertion hole 40 as shown in FIG. 1. However, there has occurred a problem in that supporting force for supporting the fin tube 10 is inhibited due to the insertion hole 40 being drilled larger than the diameter of the fin tube 10.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a connection tube support of a waste heat recovery boiler and a waste heat recovery boiler including the same, which are capable of stably supporting a connection tube preventing damage to the connection tube due to the motion even in situations of thermal-expansion-induced movements of the connection tube through which a fluid flows exchanging heat with exhaust gas and of a tube sheet supporting the connection tube.

In order to achieve the above objective, according to the present disclosure, there may be provided a connection tube support of a waste heat recovery boiler supporting a connection tube unit having a plurality of connection tubes that is disposed inside a waste heat recovery boiler and performs heat exchange between a fluid flowing inside and exhaust gas flowing outside, the connection tube support including: a header storing fluid flowing through the connection tube unit and supporting one end of the connection tube unit by being connected to one end of the connection tube unit; and a tube sheet supporting a circumferential surface of each of the plurality of connection tubes, wherein the tube sheet may have the plurality of connection tubes passing therethrough and be provided with a plurality of support holes respectively supporting circumferential surfaces of the plurality of connection tubes passing therethrough.

In the connection tube support of a waste heat recovery boiler according to the present disclosure, the header and the tube sheet may be installed on an inner wall of a casing part of the waste heat recovery boiler, wherein a plurality of the tube sheets may be installed to be spaced apart from each other in a longitudinal direction of the connection tube unit.

Each of the support holes may be in a long-hole shape.

A width (W) of each of the support holes may be $W=D+a$ compared with an outer diameter (D) of each of the connection tubes, and a length (L) of each of the support holes may be longer than the outer diameter (D) of each of the connection tubes, wherein the length (L) of each of the support holes may be $D \leq L \leq bD$ compared with the outer diameter (D) of each of the connection tubes, a range of "a" may be $1\ \text{mm} \leq a \leq 3\ \text{mm}$, and a range of "b" may be $1.3 \leq b \leq 1.7$.

When the tube sheet pertains to a condition of moving in an upper direction according to a thermal expansion analysis thereon, the connection tube may be positioned on an upper side part of the support hole.

When the tube sheet pertains to a condition of moving in upper and lower directions according to a thermal expansion analysis thereon, the connection tube may be positioned in a central part of the support hole.

When the tube sheet pertains to a condition of moving in a lower direction according to a thermal expansion analysis thereon, the connection tube may be positioned on a lower side part of the support hole.

The plurality of support holes may be disposed in a plurality of rows on the tube sheet. Wherein a first row and a second row are adjacent to each other, the plurality of support holes in a second row may be positioned between the plurality of support holes in the first row.

Wherein a plurality of support holes is provided in a third row which is adjacent to the second row, the plurality of support holes in the third row may be positioned on the same line as the plurality of support holes in the first row, and wherein a plurality of support holes is provided in a fourth row which is adjacent to the third row, the plurality of support holes in the fourth row may be positioned on the same line as the plurality of support holes in the second row.

In addition, there may be provided a waste heat recovery boiler, the boiler including: a casing part providing a flow path through which exhaust gas flows; a connection tube unit disposed inside the casing part and having a plurality of connection tubes provided to be perpendicular to a flow direction of the exhaust gas inside the casing part, the connection tube unit configured to perform heat exchange between a fluid flow inside the connection tube unit and the exhaust gas; and a connection tube support supporting the connection tube unit that is disposed inside the casing part and exchanges heat with a fluid flowing inside and exhaust gas flowing outside, wherein the connection tube support may include: a header storing fluid flowing through the connection tube unit and supporting one end of the connection tube unit by being connected to one end of the connection tube unit; and a tube sheet supporting a circumferential surface of each of the plurality of connection tubes, wherein the tube sheet may have the plurality of connection tubes passing therethrough and be provided with a plurality of support holes respectively supporting circumferential surfaces of the plurality of connection tubes passing therethrough.

As described above, according to a connection tube support of a waste heat recovery boiler and a waste heat recovery boiler including the same, even when a motion of the connection tube through which a fluid that exchanges heat with exhaust gas flows and a tube sheet supporting the connection tube occurs due to thermal expansion, the connection tube can be stably supported while flexibility for the motion thereof is secured by the long hole-shaped support hole provided in the tube sheet.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Hereinafter, exemplary embodiments according to the present disclosure will be described in detail with reference to the accompanying drawings. Prior to this, it is noted that terms or words used in the present specification and claims should not be construed as being limited to the usual or dictionary meaning because, on the basis of the principle that the inventor may define the concept of the terms in order to explain his/her invention in the best way, the terms and words should be interpreted as meaning and concept consistent with the technical idea of the present disclosure.

Figure 1:
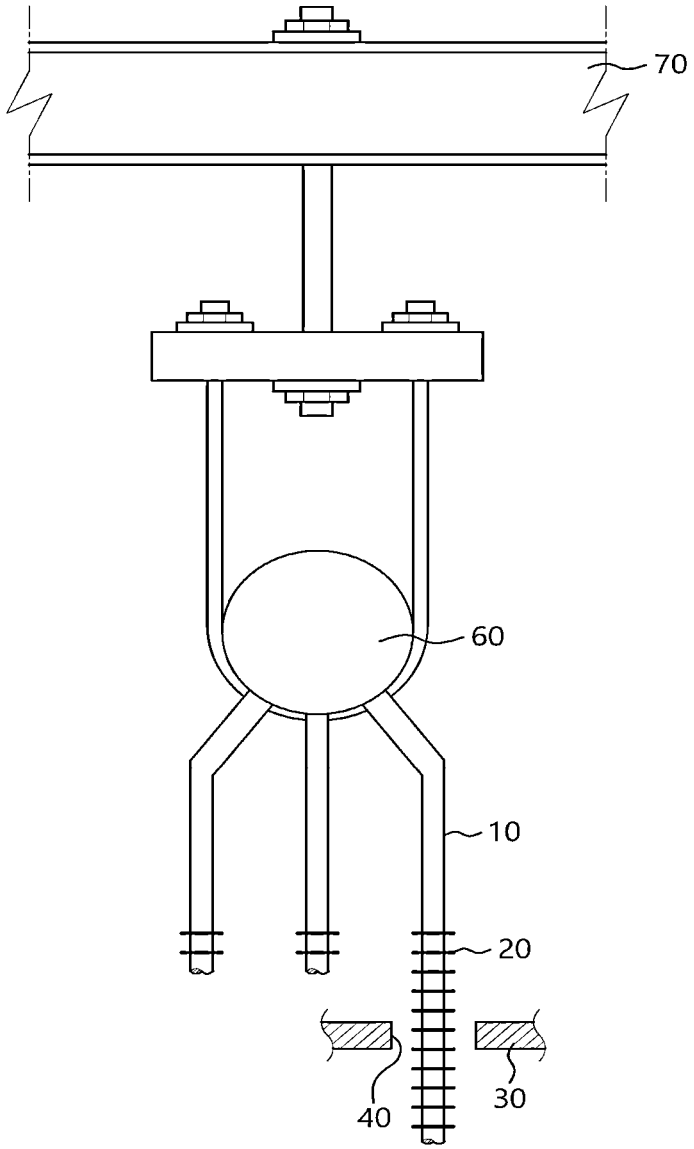
FIG. 1 is a view schematically showing an installation state of a fin tube support and a fin tube used in a conventional waste heat recovery boiler.
Figure 2:
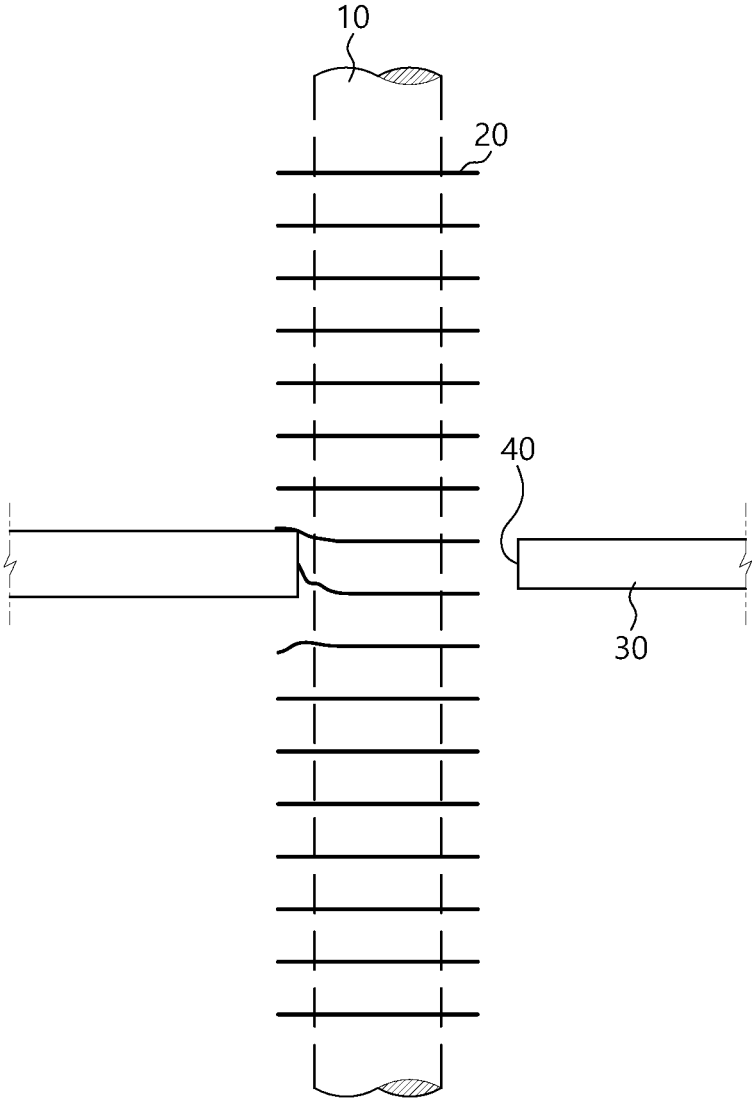
FIG. 2 is a view schematically showing a phenomenon in which a movement of a fin tube is restricted in a conventional fin tube support shown in FIG. 1.
Figure 3:
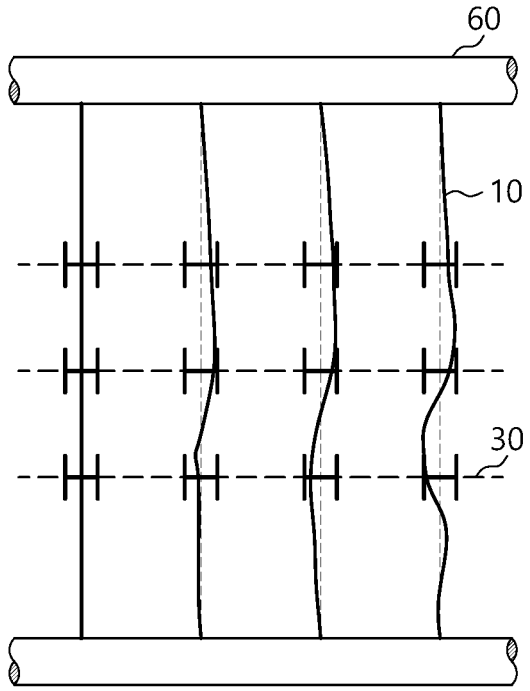
FIG. 3 is a view schematically showing a local buckling phenomenon of a fin tube due to the restricted phenomenon of FIG. 2.
Figure 4:
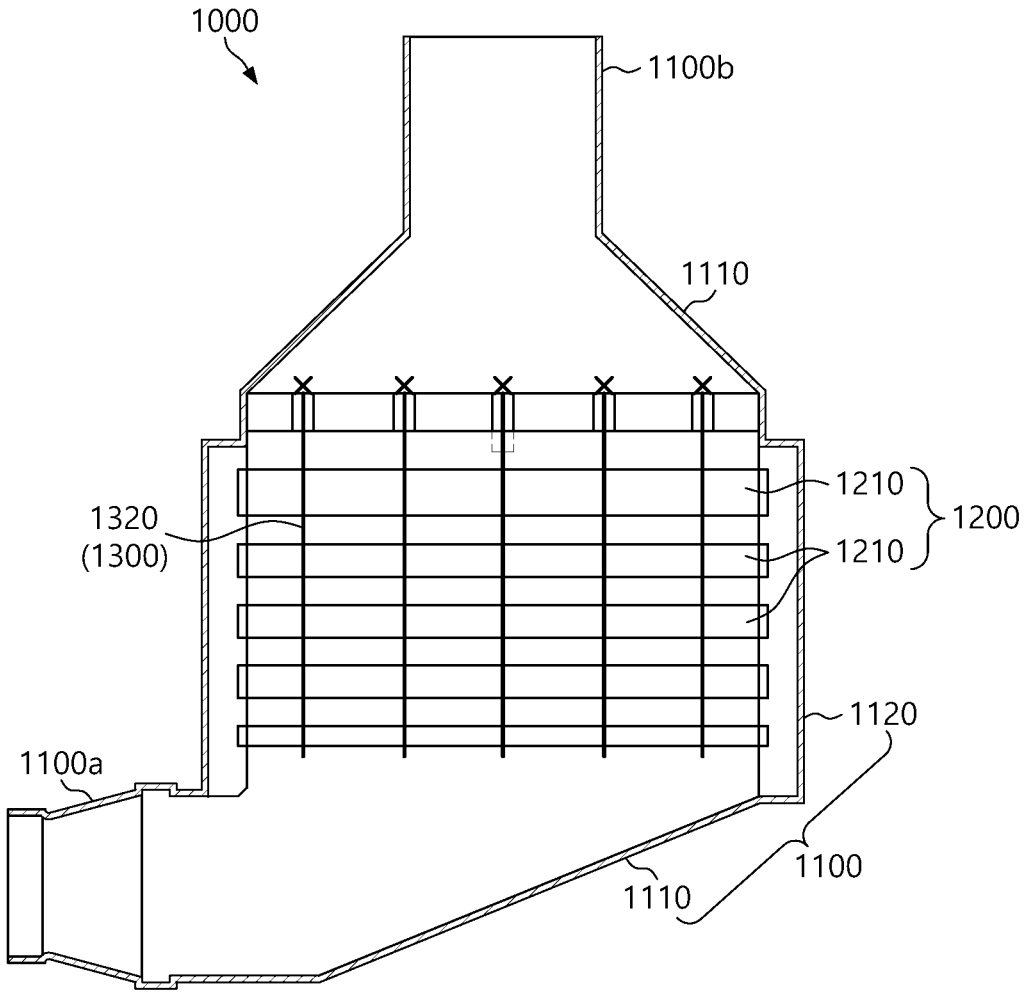
FIG. 4 is a view schematically showing a waste heat recovery boiler according to an embodiment of the present disclosure.

With reference to FIG. 4, a waste heat recovery boiler 1000 according to an embodiment of the present disclosure includes a casing part 1100, a connection tube unit 1200, and a connection tube support 1300, wherein the casing part 1100 has a substantially cubic shape and provides a flow path through which exhaust gas flows.

The casing part 1100 is provided inside thereof with the connection tube unit 1200 composed of a plurality of connection tubes disposed in a direction perpendicular to the flow direction of exhaust gas, wherein the plurality of connection tubes 1210 included in the connection tube unit 1200 is partitioned into a plurality of sections, and the plurality of connection tubes 1210 partitioned above is classified into superheaters, evaporators, and the like according to the roles thereof.

The casing part 1100 includes casings 1110 and a thermal expansion absorbing member 1120. The casing part 1100 includes at least two casings 1110 separated from each other, and the casings 1110 separated from each other may be connected by the mediation of the thermal expansion absorbing member 1120 capable of absorbing deformation due to thermal expansion.

One side of the casing 1100 may be provided with a gas inlet 1100*a* through which the exhaust gas of a gas turbine (not shown) is introduced, and an opposite side may be provided with a gas outlet 1100*b* for discharging the exhaust gas into the atmosphere.

The casing 1110 may be provided in a metallic material, thereby being able to be thermally expanded by high-temperature exhaust gas, and the thermal expansion absorbing member 1120 is configured to have fluidity in order to mitigate the thermal expansion of the casings 1110 separated from each other.

Figure 5:
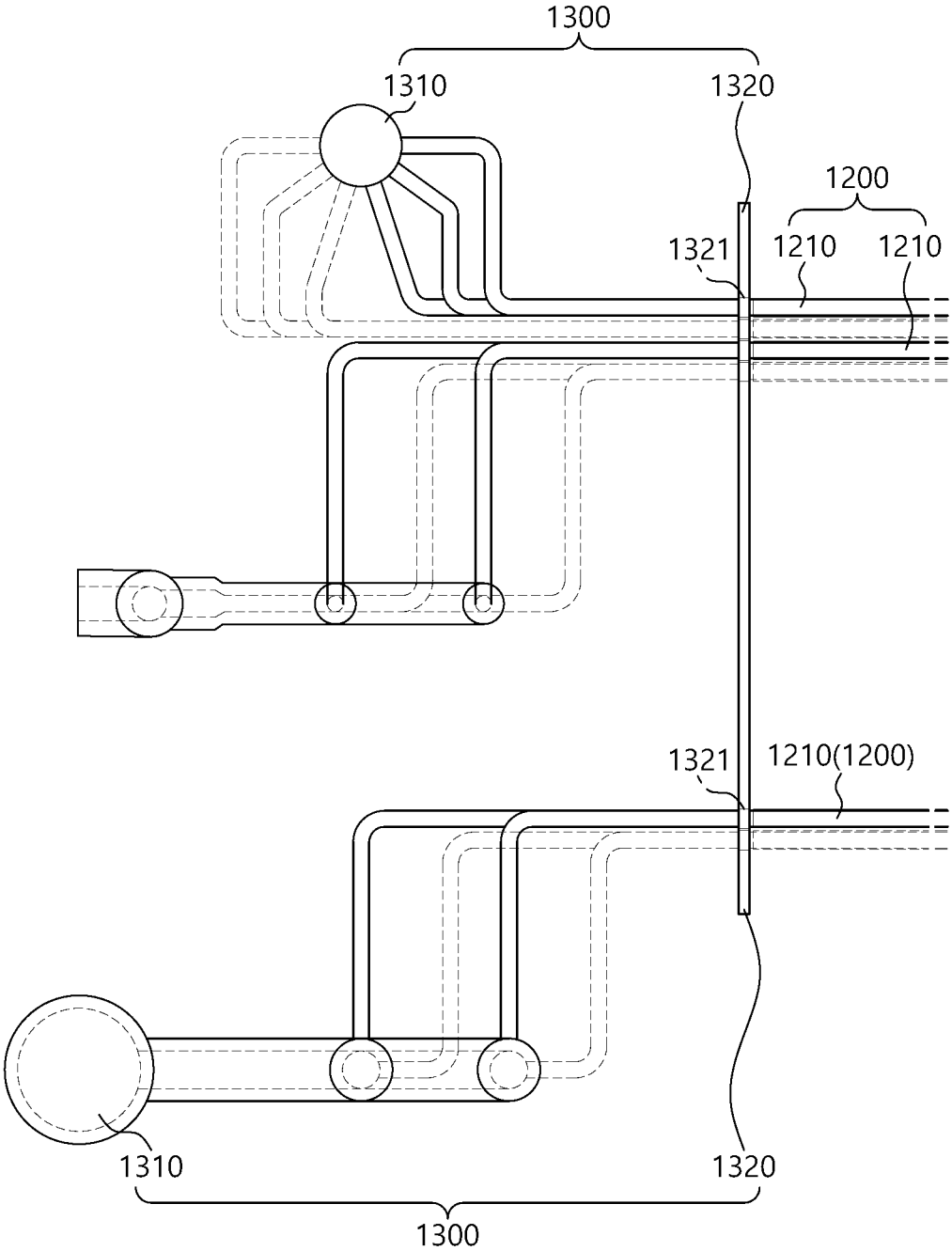
FIG. 5 is a view schematically showing a state in which a connection tube is supported by a connection tube support in FIG. 4.

With reference to FIGS. 4 and 5, the connection tube unit 1200, provided inside the casing part 1100 and perpendicular to the exhaust gas flow direction, is supported by the connection tube support 1300. The connection tube support 1300 includes a header 1310 and a tube sheet 1320. In FIGS. 4 and 5, the direction in which the exhaust gas flows from the bottom to the top of the thermal expansion absorbing member 1120 may be referred to as an upper direction or an upward direction and a direction opposite to the upper direction may be referred to as a lower direction or a downward direction. The upward and the downward directions may be referred to as a vertical direction, collectively.

The header 1310 stores the fluid that flows through the connection tube 1210 of the connection tube unit 1200. It is connected to one end of the connection tube 1210, providing support for that one end of the connection tube 1210. The header 1310 may be installed on an inner wall surface of the casing part 1100.

The tube sheet 1320 supports a plurality of connection tubes 1210, with their one ends connected to the header 1310. The tube sheet 1320 is designed to have the plurality of connection tubes 1210 pass through it, and it is provided with a plurality of support holes 1321. These support holes 1321 are specifically positioned to support circumferential surfaces of the plurality of connection tubes 1210 as they pass through the tube sheet 1320. The plurality of support holes 1321 provided in the tube sheet 1320 supports circumferential surfaces of the plurality of connection tubes 1210, respectively, and a plurality of tube sheets 1320 is installed to be spaced apart from each other in a longitudinal direction of the plurality of connection tubes 1210. Each of the plurality of tube sheets 1320 may be generally in a form of a flat plane, disposed parallel to the upper and the lower directions.

Figure 6:
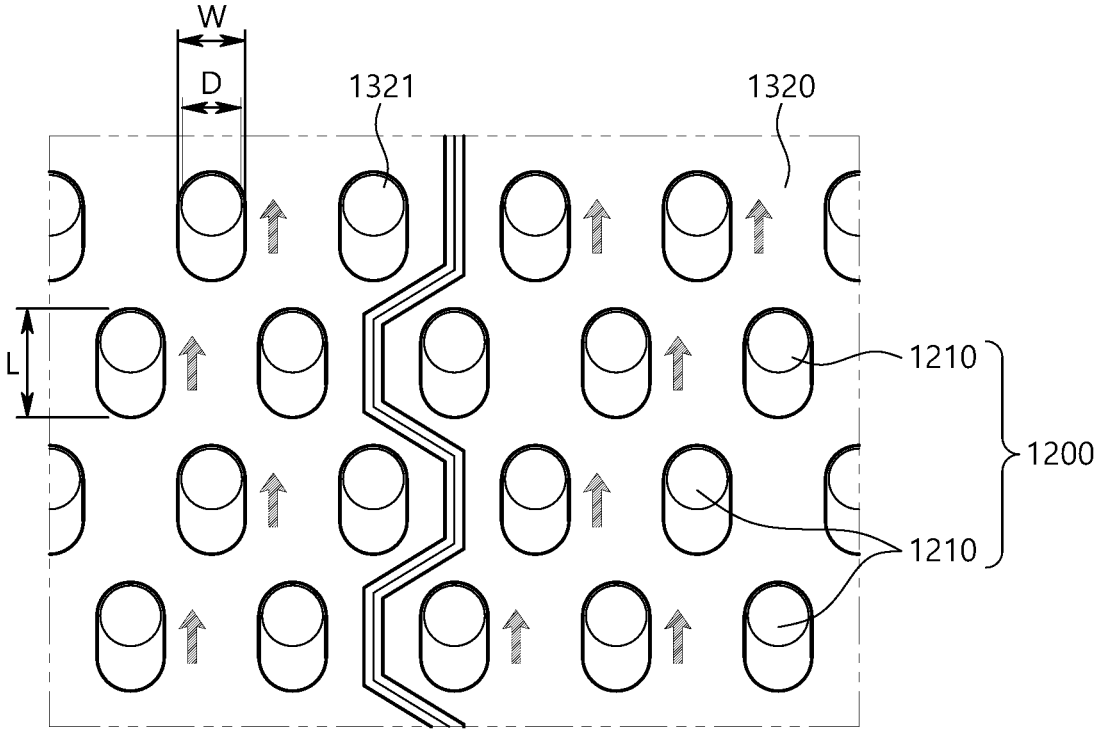
FIG. 6 is a view schematically showing a state in which the connection tube shown in FIG. 5 is supported by the tube sheet according to a first embodiment.

With reference to FIGS. 5 and 6, the plurality of support holes 1321 provided in the tube sheet 1320 has a long hole shape, where its length is in the upper and lower directions and is larger than its width. The width of the long hole shape is in a perpendicular direction to the upper and the lower directions. The width W of the support hole 1321 may be larger than an outer diameter D of the connection tube having the width W being W=D+a. According to an embodiment, the range of a may be 1 mm≤a≤$^3$ mm. In addition, the length L of the support hole 1321 may be larger than the outer diameter D of the connection tube 1210. For example, the length L of the support hole may be D≤L≤bD compared with the outer diameter D of the connection tube. According to an embodiment, the range of b may be 1.3≤b≤1.7, in other words, L being larger than D by 1.3 times to 1.7 times.

When the length L of the support hole 1321 is longer than the outer diameter D of the connection tube 1210 by greater than 1.7 times, an impact caused by the flow of the tube sheet 1320 may be transferred to the connection tube 1210, and the connection tube 1210 may be damaged. In the case in which the length L of the support hole 1321 is equal to the outer diameter of the connection tube 1210, when the tube sheet 1320 flows due to thermal expansion, a problem that can occur is that the connection tube 1210 flows together.

Figure 7:
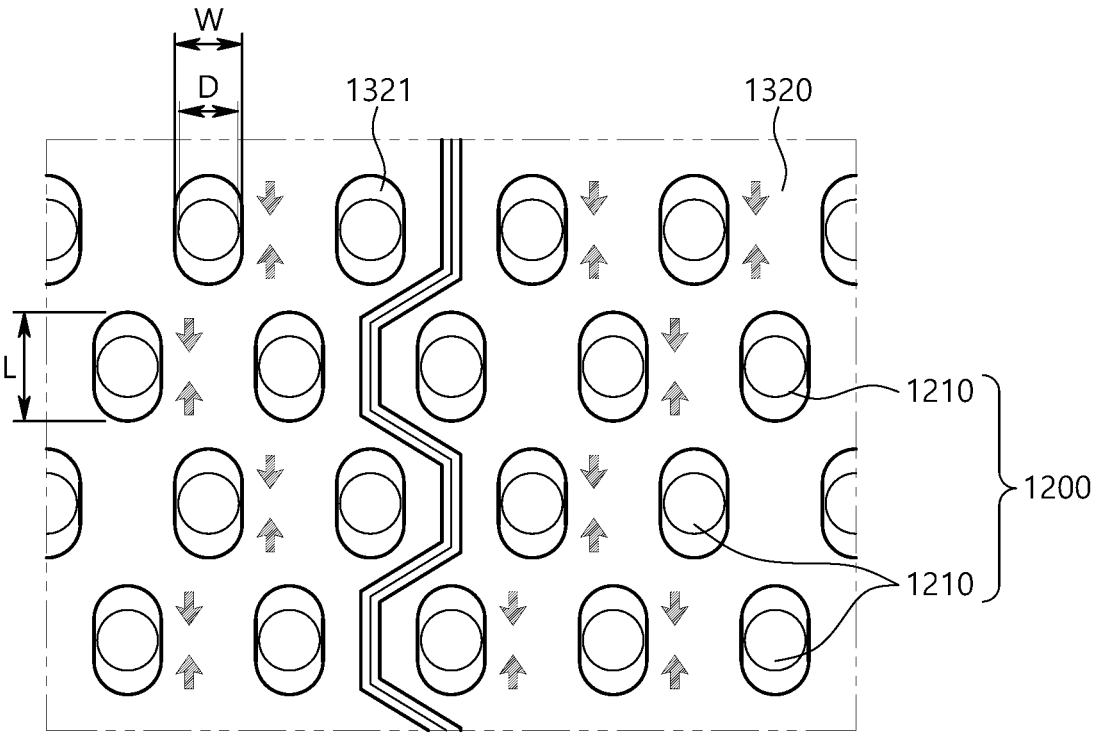
FIG. 7 is a view schematically showing a state in which the connection tube shown in FIG. 5 is supported by a tube sheet according to a second embodiment.
Figure 8:
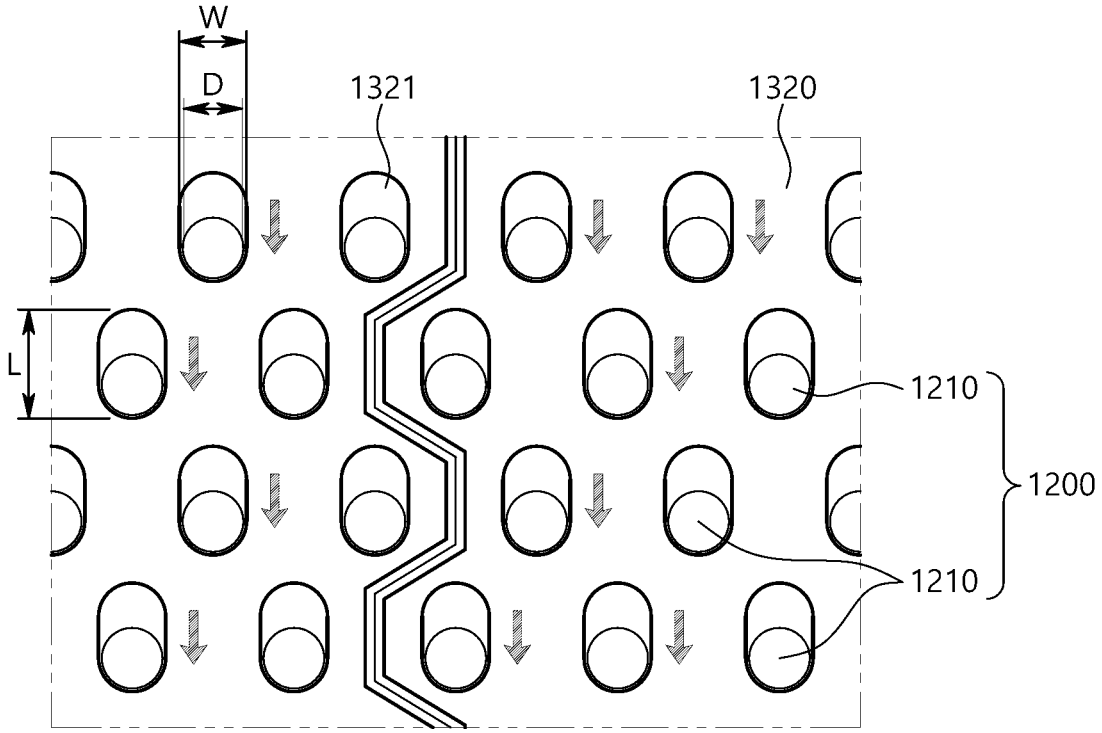
FIG. 8 is a view schematically showing a state in which the connection tube shown in FIG. 5 is supported by a tube sheet according to a third embodiment.

With reference to FIGS. 6 to 8, the position of the connection tube 1210 inserted into the support hole 1321 of the tube sheet 1320 may be adjusted according to the thermal expansion analysis of the tube sheet 1320 supporting the connection tube 1210. As a result of the thermal expansion analysis, the tube sheet 1320 may pertains to a condition of moving in the upward direction, in other words, may be expected to move in the upward direction under the thermal expansion. Instead, as the result of the thermal expansion analysis, the tube sheet 1320 may pertain to a condition of moving in the downward direction, in other words, may be expected to move in the downward direction under the thermal expansion. Still instead, as the result of the thermal expansion analysis, the tube sheet 1320 may pertain to a condition of moving both in the upward and downward direction, in other words, may be expected to move both in the upward and downward direction under the thermal expansion. According to such analysis, the position of insertion of a connection tube 1210 into a corresponding support hole 1321 may be adjusted before the thermal expansion.

For example, when the tube sheet 1320 pertains to a condition of moving in an upper direction according to the thermal expansion analysis, the connection tube 1210 may be positioned on an upper side part of the support hole 1321 (see FIG. 6). In other words, when the position of the support holes 1321 are expected to change upward during thermal expansion of the tube sheet 1320, the connection tube 1210 may be inserted into the support hole before the thermal expansion such that the connection tube 1210 may be positioned on an upper side part of the support hole 1321.

When the connection tube 1210 is inserted to be positioned on the upper side part of the support hole 1321 provided in the tube sheet 1320 before the thermal expansion, a space is secured at a lower part of the support hole 1321. This arrangement helps eliminate any potential constraints that may occur when the tube sheet 1320 and the support holes 1321 therein moves upward during thermal expansion.

When the tube sheet 1320 pertains to a condition of moving in a lower direction according to the thermal expansion analysis, the connection tube 1210 may be positioned on a lower side part of the support hole 1321 (see FIG. 8). In other words, when the position of the support holes 1321 is expected to change downward during thermal expansion of the tube sheet 1320, the connection tube 1210 may be inserted into the support hole before the thermal expansion such that the connection tube 1210 may be positioned on a lower side part of the support hole 1321.

When the connection tube 1210 is inserted to be positioned on the lower side part of the support hole 1321 provided in the tube sheet 1320 before the thermal expansion, a space is secured at the upper part of the support hole 1321 This arrangement helps eliminate any potential constraints that may occur when the tube sheet 1320 and the support holes 1321 therein moves downward during thermal expansion.

When the tube sheet 1320 pertains to a condition of moving in the upper and lower directions according to the thermal expansion analysis, the connection tube 1210 may be positioned in a central part of the support hole 1321 (see FIG. 7). In other words, in this case, the connection tube 1210 may be inserted into the support hole before the thermal expansion such that the connection tube 1210 may be positioned in a central part of the support hole 1321.

In this case, a space is secured at both of upper and lower parts of the support hole 1321, whereby constraining conditions may be removed that may occur during thermal expansion.

With reference to FIGS. 6 to 8, the plurality of support holes 1321 may be disposed in a plurality of rows on the tube sheet 1320. The plurality of rows may be arranged along the vertical direction. In each row, a plurality of support holes 1321 are present, and they may be uniformly spaced apart from each other at equal same intervals. When the tube sheet 1320 is erected and installed inside the casing part 1100, and when the first row is adjacent to the second row, a plurality of support holes 1321 in a second row are positioned between the plurality of support holes 1321 in the first row.

Furthermore, when the third row is adjacent to the second row, the plurality of support holes 1321 in the third row is positioned on the same line as the plurality of support holes 1321 in the first row in the vertical direction, and when the fourth row is adjacent to the third row, a plurality of support holes 1321 in a fourth row is positioned on the same line as the plurality of support holes 1321 in the second row in the vertical direction.

Out of the plurality of support holes 1321 disposed in the plurality of rows in the tube sheet 1320, a plurality of odd-numbered support holes 1321 is positioned on the same line in the vertical direction, and a plurality of even-numbered rows of support holes 1321 is positioned between and in the middle of the odd-numbered rows of support holes 1321, whereby on the tube sheet 1320, the plurality of odd-numbered and even-numbered support holes 1321 is arranged in a zigzag shape. As a result of this arrangement, smooth heat exchange occurs between the exhaust gas flowing into the casing part 1100 and the fluid moving through the plurality of connection tubes 1210. The positioning and spacing of the support holes in the tube sheet 1320 allow for efficient and effective heat exchange between the two mediums.

Furthermore, the long hole-shaped support holes 1321 provided in the tube sheet 1320 enables stable support of the connection tube 1210 while maintain flexibility to accommodate the thermal expansion-induced motion of the connection tube 1210 and the tube sheet 1320. This design feature allows the connection tube 1210, through which heat-exchanging fluid flow and exchanges heat with exhaust gas, to be effectively supported and ensure its motion is accommodated without compromising stability.

Although the present disclosure has been described with reference to the embodiments shown in the drawings, this is only exemplary, and those skilled in the art will understand that various modifications and equivalent other embodiments are possible therefrom. Therefore, the true technical protection scope of the present disclosure should be determined by the spirit of the technical writings of the appended claims.

The invention claimed is:

1. A connection tube support of a waste heat recovery boiler supporting a connection tube unit having a plurality of connection tubes that is disposed inside a waste heat recovery boiler and perform heat exchange between a fluid flowing inside and exhaust gas flowing outside, the connection tube support comprising:

a header storing fluid flowing through the connection tube unit and supporting one end of the connection tube unit by being connected to one end of the connection tube unit; and a tube sheet supporting a circumferential surface of each of the plurality of connection tubes, wherein the tube sheet has the plurality of connection tubes passing therethrough and is provided with a plurality of support holes respectively supporting circumferential surfaces of the plurality of connection tubes passing therethrough, wherein each of the plurality of support holes is in a long hole shape formed substantially perpendicular to its respective connection tube.

2. The connection tube support of claim 1, wherein the header and the tube sheet are installed on an inner wall of a casing part of the waste heat recovery boiler, wherein a plurality of the tube sheets is installed to be spaced apart from each other in a longitudinal direction of the connection tube unit.

3. The connection tube support of claim 1, wherein a width (W) of each of the support holes is W=D+a compared with an outer diameter (D) of each of the connection tubes, and a length (L) of each of the support holes is longer than the outer diameter (D) of each of the connection tubes, wherein the length (L) of each of the support holes is $D \leq L \leq bD$ compared with the outer diameter (D) of each of the connection tubes, a range of the a is 1 mm$\leq a \leq$3 mm, and a range of the b is $1.3 \leq b \leq 1.7$.

4. The connection tube support of claim 3, wherein, when the tube sheet pertains to a condition of moving in an upper direction according to a thermal expansion analysis thereon, the connection tube is positioned on an upper side part of the support hole.

5. The connection tube support of claim 3, wherein, when the tube sheet pertains to a condition of moving in upper and lower directions according to a thermal expansion analysis thereon, the connection tube is positioned in a central part of the support hole.

6. The connection tube support of claim 3, wherein, when the tube sheet pertains to a condition of moving in a lower direction according to a thermal expansion analysis thereon, the connection tube is positioned on a lower side part of the support hole.

7. The connection tube support of claim 1, wherein the plurality of support holes is disposed in a plurality of rows on the tube sheet, and a first row and a second row are adjacent to each other, and wherein the plurality of support holes in a second row is positioned between the plurality of support holes in the first row.

8. The connection tube support of claim 7, wherein a plurality of support holes is provided in a third row which is adjacent to the second row, the plurality of support holes in the third row is positioned on the same line as the plurality of support holes in the first row, and wherein a plurality of support holes is provided in a fourth row which is adjacent to the third row, the plurality of support holes in the fourth row is positioned on the same line as the plurality of support holes in the second row.

9. A waste heat recovery boiler, the boiler comprising:

a casing part providing a flow path through which exhaust gas flows;

a connection tube unit disposed inside the casing part and having a plurality of connection tubes provided to be perpendicular to a flow direction of the exhaust gas inside the casing part, the connection tube unit configured to perform heat exchange between a fluid flow inside the connection tube unit and the exhaust gas; and a connection tube support supporting the connection tube unit, wherein the connection tube support comprises:

a header storing fluid flowing through the connection tube unit and supporting one end of the connection tube unit by being connected to one end of the connection tube unit; and a tube sheet supporting a circumferential surface of each of the plurality of connection tubes, wherein the tube sheet has the plurality of connection tubes passing therethrough and is provided with a plurality of support holes respectively supporting circumferential surfaces of the plurality of connection tubes passing therethrough, wherein the casing part comprises:

at least two casings separated from each other, wherein the casings separated from each other are connected by mediation of a thermal expansion absorbing member capable of absorbing deformation due to thermal expansion.

10. The boiler of claim 9, wherein the connection tube support is installed on an inner wall of the casing part of the waste heat recovery boiler, wherein a plurality of tube sheets is installed to be spaced apart from each other in a longitudinal direction of the plurality of connection tubes.

11. The boiler of claim 9, wherein each of the support holes is in a long hole shape, wherein a width (W) of each of the support holes is $W=D+a$ compared with an outer diameter (D) of each of the connection tubes, and a length (L) of each of the support holes is longer than the outer diameter (D) of each of the connection tubes, wherein the length (L) of each of the support holes is $D \leq L \leq bD$ compared with the outer diameter (D) of each of the connection tubes, a range of the a is $1\ mm \leq a \leq 3\ mm$, and a range of the b is $1.3 \leq b \leq 1.7$.

12. The boiler of claim 11, wherein, when the tube sheet pertains to a condition of moving in an upper direction according to a thermal expansion analysis thereon, the connection tube is positioned on an upper side part of the support hole.

13. The boiler of claim 11, wherein, when the tube sheet pertains to a condition of moving in upper and lower directions according to a thermal expansion analysis thereon, the connection tube is positioned in a central part of the support hole.

14. The boiler of claim 11, wherein, when the tube sheet pertains to a condition of moving in a lower direction according to a thermal expansion analysis thereon, the connection tube is positioned on a lower side part of the support hole.

15. The boiler of claim 9, wherein the plurality of support holes is disposed in a plurality of rows on the tube sheet, and a first row and a second row are adjacent to each other, and wherein the plurality of support holes in a second row is positioned between the plurality of support holes in the first row.

16. The boiler of claim 15, wherein a plurality of support holes is provided in a third row which is adjacent to the second row, the plurality of support holes in the third row is positioned on the same line as the plurality of support holes in the first row, wherein a plurality of support holes is provided in a fourth row which is adjacent to the third row, the plurality of support holes in the fourth row is positioned on the same line as the plurality of support holes in the second row.

* * * * *